United States Patent [19]

Gilmore et al.

[11] Patent Number: 4,803,042

[45] Date of Patent: Feb. 7, 1989

[54] NUCLEAR REACTOR CORE COMPONENT SHIPPING CONTAINER

[75] Inventors: Charles B. Gilmore, Columbia, S.C.; James L. Kisak, Plum Boro, Pa.; Jeffrey P. Oberst, Penn Hills Twp., Pa.; John D. Wood, Hempfield Twp., Pa.; Frank J. Baloh, Dawson, Pa.

[73] Assignee: Westinghouse Electric Corp., Pittsburgh, Pa.

[21] Appl. No.: 124,318

[22] Filed: Nov. 23, 1987

[51] Int. Cl.[4] ..... G21C 19/00

[52] U.S. Cl. ..... 376/272

[58] Field of Search ..... 376/272; 250/506.1, 250/507.1; 252/633

[56] References Cited

U.S. PATENT DOCUMENTS

| | | | |
|---|---|---|---|
| 3,111,586 | 11/1963 | Rogers | 376/272 |
| 3,179,243 | 4/1965 | Ashcroft | 376/272 |
| 3,229,096 | 1/1966 | Bonilla et al. | 376/272 |
| 3,575,601 | 4/1971 | Lindsay et al. | 376/272 |
| 3,669,299 | 6/1972 | Jones et al. | 220/10 |
| 3,754,141 | 8/1973 | Leebl et al. | 250/507 |
| 3,828,197 | 8/1974 | Boldt | 250/506 |
| 3,845,315 | 10/1974 | Blum | 376/272 |
| 3,935,467 | 1/1976 | Gablin | 250/507 |
| 3,971,955 | 7/1976 | Heyer et al. | 250/507 |
| 4,152,585 | 5/1979 | Myers | 376/272 |
| 4,190,160 | 2/1980 | Anderson et al. | 206/591 |
| 4,218,622 | 8/1980 | McMurtry et al. | 250/518 |
| 4,382,512 | 5/1983 | Furminger | 206/446 |
| 4,560,069 | 12/1985 | Simon | 206/591 |
| 4,625,122 | 11/1986 | Botzem et al. | 250/560.1 |
| 4,627,956 | 12/1986 | Botzem et al. | 376/272 |
| 4,636,351 | 1/1987 | Rohr | 376/272 |

FOREIGN PATENT DOCUMENTS

| | | | |
|---|---|---|---|
| 3131126 | 2/1983 | Fed. Rep. of Germany . | |
| 2468979 | 5/1981 | France . | |
| 0132100 | 10/1979 | Japan | 376/272 |
| 0129699 | 7/1985 | Japan . | |
| 0201292 | 10/1985 | Japan | 376/272 |
| 2076498 | 4/1987 | Japan | 376/272 |

*Primary Examiner*—Deborah L. Kyle
*Assistant Examiner*—Daniel Wasil

[57] ABSTRACT

A shipping container is provided for use in containing and supporting a nuclear core component assembly, such as a control or poison assembly. The shipping container includes a separate rigid cylindrical body and lid of plastic material, a plurality of elongated tubes of plastic material, and foam plastic rigid flat cylindrical spacer plates. The tubes are inserted into the body for receiving and stabilizing elongated rods of the core component assembly. The spacer plates are disposed stationarily within and transversely across the body and spaced apart from one another axially along the body. Each plate has a plurality of openings therethrough for receiving and disposing the tubes in transverse side-by-side spaced relationship with respect to one another in, and extending between a closed bottom and an open top of, the body. The plates thus laterally space and support the rods when received in the tubes. The lid is hollow for receiving therein a common mounting structure of the assembly to which the rods are attached when the lid at its open bottom is installed the open top of the body. Also, overcentering lock mechanisms are provided on the lid and the body and are actuatable for latching and unlatching the lid to and from the body. An annular sealing gasket is disposable between the lid and the body for providing an air-tight seal therebetween upon latching the lid to the body.

30 Claims, 8 Drawing Sheets

NUCLEAR REACTOR CORE COMPONENT SHIPPING CONTAINER

BACKGROUND OF THE INVENTION

1. Field of the Invention

The present invention relates generally to nuclear reactors and, more particularly, is concered with a shipping container for transporting nuclear reactor core components, such as a control rod cluster assembly or a burnable absorber rod cluster assembly.

2. Description of the Prior Art

In a typical nuclear reactor, the reactor core includes a large number of fuel assemblies each of which is composed of top and bottom nozzles with a plurality of elongated transversely spaced guide thimbles extending longitudinally between the nozzles and a plurality of transverse support grids axially spaced along the guide thimbles. Also, each fuel assembly is composed of a plurality of elongated fuel elements or rods transversely spaced apart from one another and from the guide thimbles and supported by the transverse grids between the top and bottom nozzles. The fuel rods each contain fissile material and are grouped together in an array which is organized so as to provide a neutron flux in the core sufficient to support a high rate of nuclear fission and thus the release of a large amount of energy in the form of heat. A liquid coolant is pumped upwardly through the core in order to extract some of the heat generated in the core for the production of useful work.

Since the rate of heat generation in the reactor core is proportional to the nuclear fission rate, and this, in turn, is determined by the neutron flux in the core, control of heat generation at reactor start-up, during its operation and at shutdown is achieved by varying the neutron flux. Generally, this is done by absorbing excess neutrons using control rods in a rod cluster control assembly (hereinafter referred to as a control assembly) which contain neutron absorbing material. The guide thimbles, in addition to being structural elements of the fuel assembly, also provide channels for insertion of the neutron absorber control rods within the reactor core. The level of neutron flux and thus the heat output of the core is normally regulated by the movement of the control rods into and from the guide thimbles.

Also, it is conventional practice to design an excessive amount of neutron flux into the reactor core at start-up so that as the flux is depleted over the life of the core there will still be sufficient reactivity to sustain core operation over a long period of time. In view of this practice, in some reactor applications burnable absorber or poison rods in a burnable absorber cluster assembly (hereinafter referred to as a poison assembly) are inserted within the guide thimbles of some fuel assemblies to assist the control rods in the guide thimbles of other fuel assemblies in maintaining the neutron flux or reactivity of the reactor core relatively constant over its lifetime. The burnable absorber rods, like the control rods, contain neutron absorber material. They differ from the control rods mainly in that they are maintained in stationary positions within the guide thimbles during their period of use in the core.

It is, of course, necessary to transport core components, such as the above-described control assembly and poison assembly, from their location of manufacture to the site of the nuclear reactor. Heretofore, for a number of years, core components have been shipped in wood containers (or boxes). The wood container typically includes an inner and outer box. Recent problems associated with the use of such containers include core components arriving at the site with sawdust and moisture on them. Also, since the rods of the assembly components are supported by plywood spacers, long term storage of components within the containers is not recommended because of potential contamination with halogens and other elements which may leach out of the adhesive in the plywood.

Consequently, a need exists for an alternative approach to construction of shipping containers for transporting reactor core components. A variety of different container constructions appear in the prior art for shipping and storage of radioactive materials. Representative of the prior art containers are those disclosed in U.S. Pat. Nos. to Leebl et al (3,754,141), Boldt (3,828,197), Gablin (3,935,467), Heyer et al (3,971,955), Andersen et al (4,190,160), McMurtry et al (4,218,622) and Botzem et al (4,625,122 and 4,627,956); German patent No. 3,131,126; French patent No. 2,468,979; and Japanese patent No. 239,377. However, none of these prior art constructions appear to provide a suitable alternative approach applicable to shipping or transporting of reactor core components.

SUMMARY OF THE INVENTION

The present invention provides a reactor core component shipping container designed to satisfy the aforementioned needs. The shipping container of the present invention is cylindrical in overall configuration, composed of plastic material and designed to minimize core component shipping and handling loads. The container is also capable of being sealed in an air-tight fashion, and significantly less costly and less subject to interior contamination than a container made of wood.

Accordingly, the present invention is directed to a shipping container for use in containing and supporting a nuclear core component assembly having a common mounting structure and a plurality of spaced elongated members supported by the common structure and extending therefrom in a common direction. The shipping container comprises: (a) a rigid cylindrical body of plastic material having a closed bottom and an open top for receiving therein the elongated members of the nuclear core component assembly; (b) a plurality of elongated tubes of plastic material inserted in the body for receiving and stabilizing the elongated members of the nuclear core component assembly during transport of the container; (c) a plurality of rigid flat cylindrical spacer plates of foam plastic material disposed stationarily within and transversely across the body and spaced apart from one another axially along the body, each of the plates having a plurality of openings therethrough receiving and disposing the tubes in transverse side-by-side spaced relationship with respect to one another in, and extending between the closed bottom and open top of, the body, the plates for laterally spacing and supporting the core component members when received in the tubes; (d) a rigid cylindrical end lid composed of plastic material having a closed top and an open bottom and being installable at its open bottom on the open top of the body, the lid being hollow for receiving therein the common mounting structure of the core component assembly when the lid is installed on the body; (e) locking means on the lid and the body and being actuatable for latching and unlatching the lid to and from the body; and (f) a sealing element disposable between the open bottom of the lid and the open top of the body for providing an air-tight seal between the body and lid upon latching the lid to the body by actuation of the locking means.

More particularly, the plastic material of the body, lid and tubes is polyethylene. Further the body includes an annular rim attached about the open top of the body, and a rigid flat support plate of plastic material disposed within the rim and above an edge of the body defining the open top thereof. The support plate has a plurality of openings matching the openings through the spacing plates and supports the common mounting structure when received in the hollow lid. One of the spacing plates is disposed within the rim and between the support plate and body edge. Also, the sealing element is an annular gasket disposed on an upper edge of the rim.

Still further, the lid includes structure disposed therein of plastic foam material for supporting the common mounting structure of the core component assembly. Also, the locking means includes a plurality of over-centering lock mechanisms. The container further includes attachment means disposed on at least one of the body and lid for connecting an external lifting mechanism thereto to facilitate transporting of the container.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
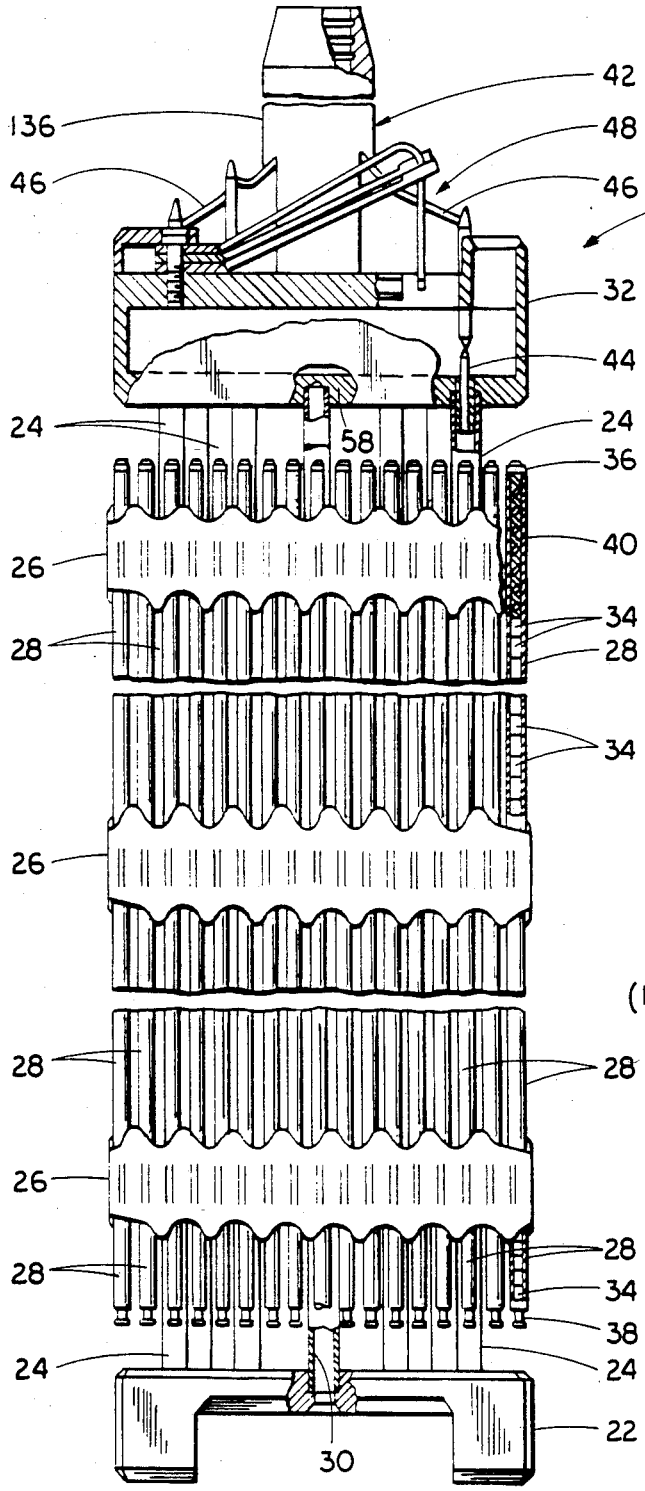
FIG. 1 (PRIOR ART)
FIG. 1 is an elevational view, partly in section, of a prior art fuel assembly being illustrated in vertically foreshortened form with parts broken away for clarity.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Prior Art Nuclear Fuel Assembly

Referring now to the drawings, and particularly, to FIG. 1, there is shown an elevational view of a prior art fuel assembly, represented in vertically foreshortened form and being generally designated by the numeral 20. The fuel assembly 20 is the type used in a pressurized water reactor (PWR) and basically includes a lower end structure or bottom nozzle 22 for supporting the assembly on the lower core plate (not shown) in the core region of a reactor (not shown), and a number of longitudinally extending guide tubes or thimbles 24 which project upwardly from the bottom nozzle 22. The assembly 20 further includes a plurality of transverse grids 26 axially spaced along the guide thimbles 24 and an organized array of elongated fuel rods 28 transversely spaced and supported by the grids 26. Also, the assembly 20 has an instrumentation tube 30 located in the center thereof and an upper end structure or top nozzle 32 attached to the upper ends of the guide thimbles 24. With such an arrangement of parts, the fuel assembly 20 forms an integral unit capable of being conventionally handled without damaging the assembly parts.

As mentioned above, the fuel rods 28 in the array thereof in the assembly 20 are held in spaced relationship with one another by the grids 26 spaced along the fuel assembly length. Each fuel rod 28 includes nuclear fuel pellets 34 and the opposite ends of the rod are closed by upper and lower end plugs 36,38 to hermetically seal the rod. Commonly, a plenum spring 40 is disposed between the upper end plug 36 and the pellets 34 to maintain the pellets in a tight, stacked relationship within the rod 28. The fuel pellets 34 composed of fissile material are responsible for creating the reactive power of the PWR. A liquid moderator/coolant such as water, or water containing boron, is pumped upwardly through the fuel assemblies of the core in order to extract some of the heat generated therein for the production of useful work.

Prior Art Control and Poison Assemblies

Figure 3:
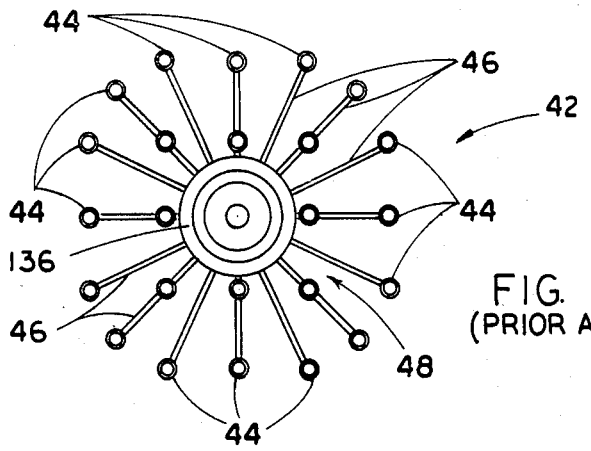
FIG. 3 (PRIOR ART)
FIG. 3 is a top plan view of the control assembly as seen along line 3—3 of FIG. 2.
Figure 2:
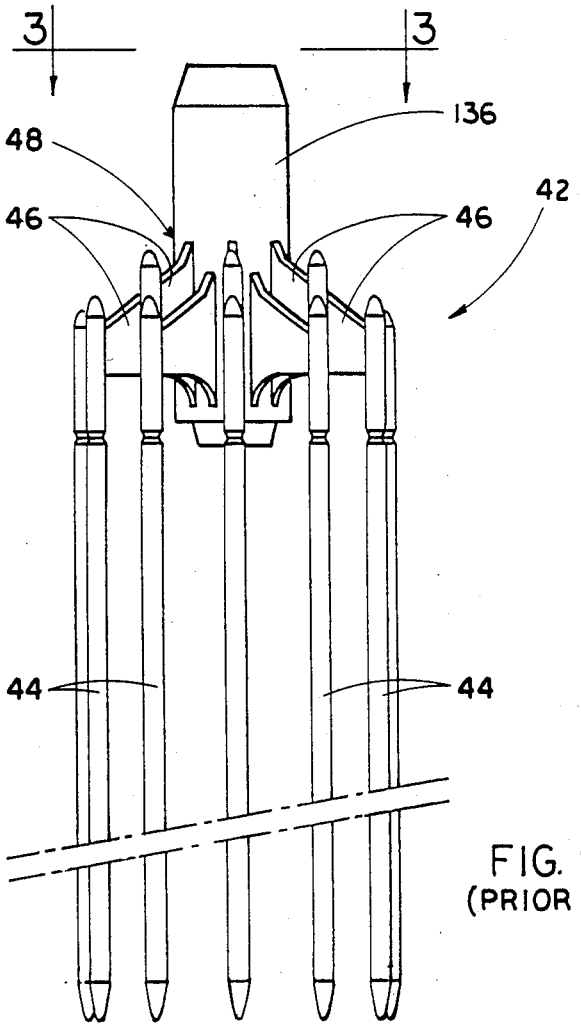
FIG. 2 (PRIOR ART)
FIG. 2 is an elevational view of a prior art control assembly removed from the fuel assembly of FIG. 1, with the control rods of the control assembly being illustrated in vertically foreshortened form.

Referring now to FIGS. 2 and 3, as well as FIG. 1, in a PWR it is desirable to control heat generation at reactor start-up, during its operation and at shutdown. This is achieved by varying neutron flux in the core which is accomplished by absorbing excess neutrons using a control assembly 42. The control assembly 42, disclosed in U.S. Pat. No. 4,326,919 to Hill and assigned to the assignee of the present invention, is shown installed in the fuel assembly 10 in FIG. 1 and separate from the fuel assembly in FIG. 2.

More particularly, the control assembly 42 includes an array of control rods 44 arranged in a pattern matched to that of the guide thimbles 24 and supported only at their upper ends by arms or flukes 46 of a spider subassembly 48. The control rods 44 each include neutron absorbing material and extend downwardly from the spider subassembly 48 and generally parallel to one another. The spider subassembly 48, in turn, is connected to a control rod drive mechanism (not shown) which is operable in a known manner to vertically raise and lower (referred to as a stepping action) the control rods 44 into and out of the hollow guide thimbles 24 of the fuel assembly 10 so as to regulate core power.

Figure 5:
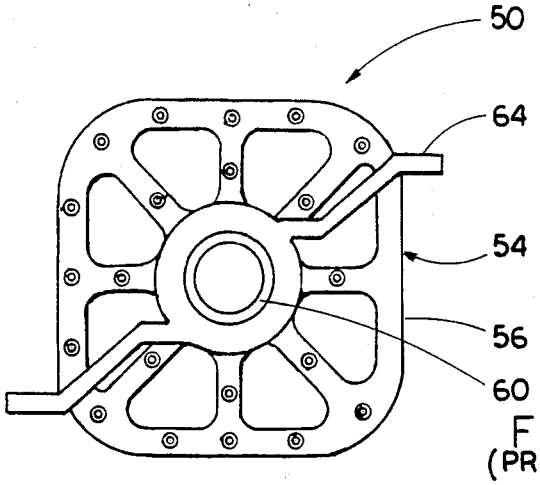
FIG. 5 (PRIOR ART)
FIG. 5 is a top plan view of the poison assembly as seen along line 5—5 of FIG. 4.
Figure 4:
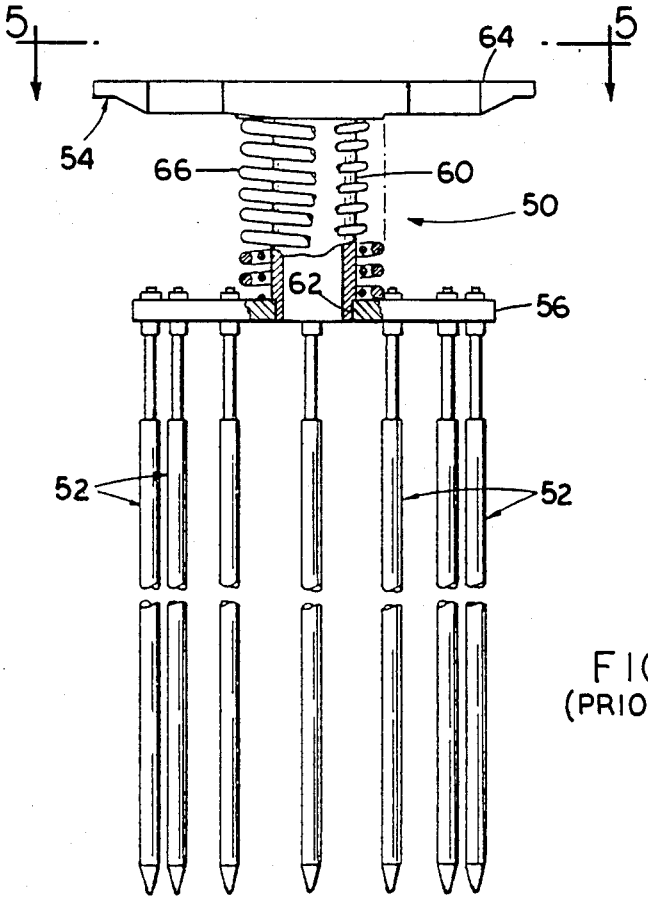
FIG. 4 (PRIOR ART)
FIG. 4 is an elevational view of a prior art poison assembly insertable in the fuel assembly of FIG. 1, with the burnable absorber rods of the poison assembly being illustrated in vertically foreshortened form.
Figure 7:
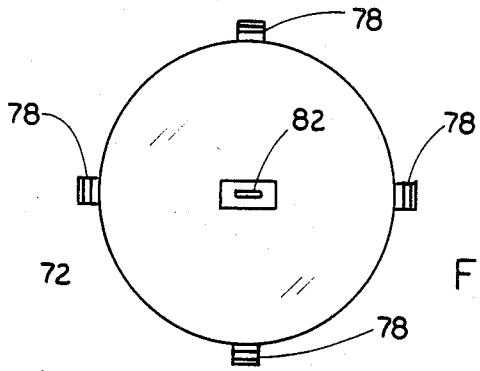
FIG. 7 is a top plan view of the shipping container as seen along line 7—7 of FIG. 6.
Figure 6:
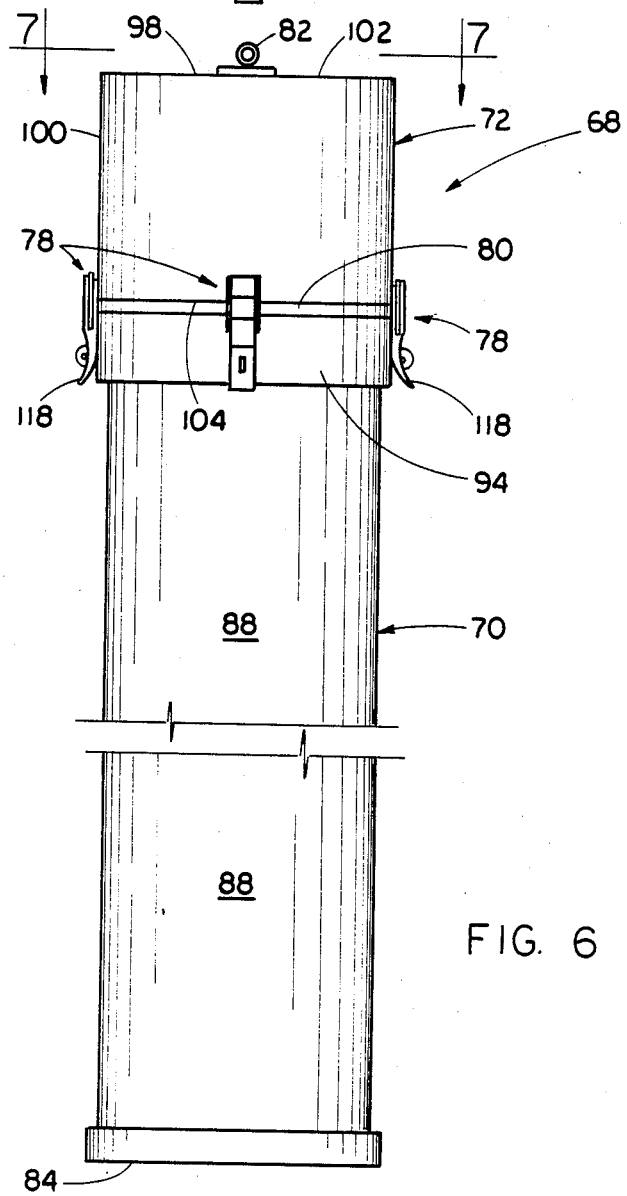
FIG. 6 is an elevational view of a shipping container for core components, such as the control and poison assemblies of FIGS. 2–5, the container being constructed in accordance with the principles of the present invention and illustrated in vertically foreshortened form.
Figure 8:
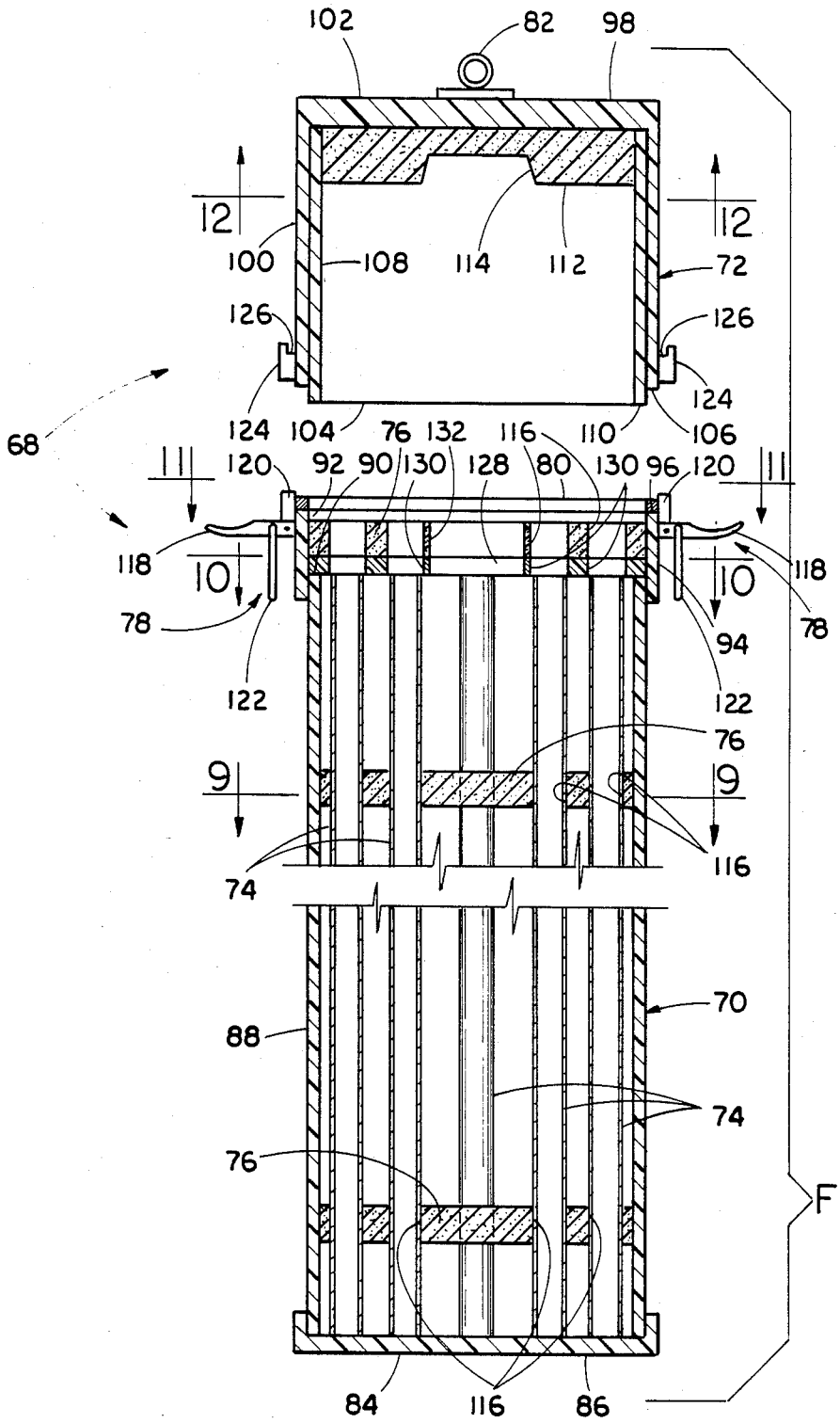
FIG. 8 is an enlarged exploded longitudinal sectional view of the shipping container of FIG. 6.
Figure 9:
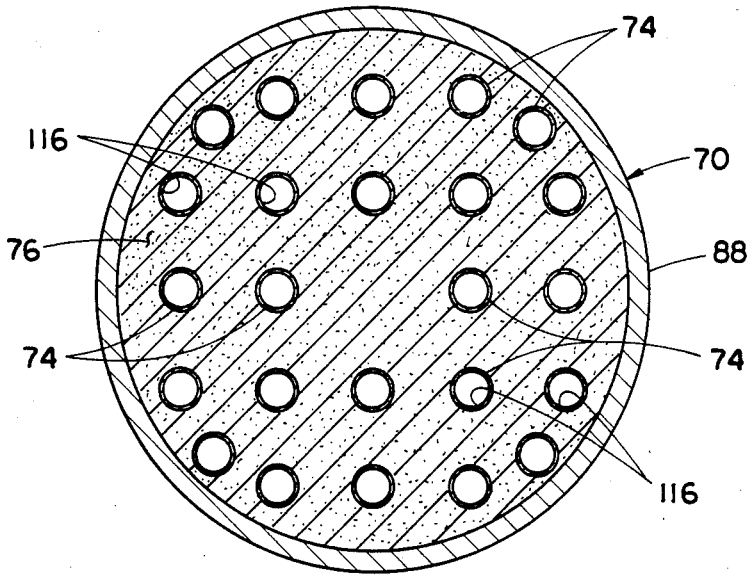
FIG. 9 is an enlarged cross-sectional view of a body of the shipping container taken along line 9—9 of FIG. 8.
Figure 10:
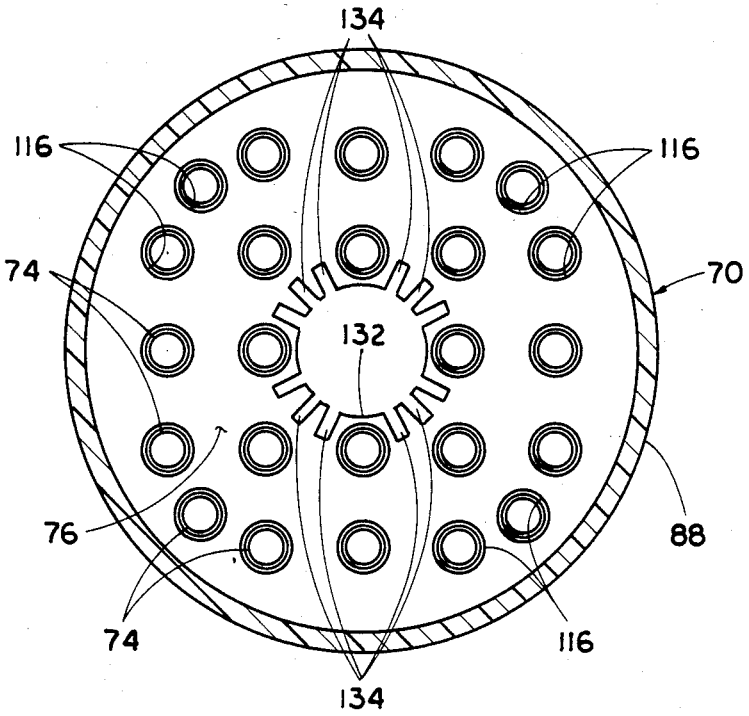
FIG. 10 is another enlarged cross-sectional view of the body of the shipping container taken along line 10—10 of FIG. 8.
Figure 11:
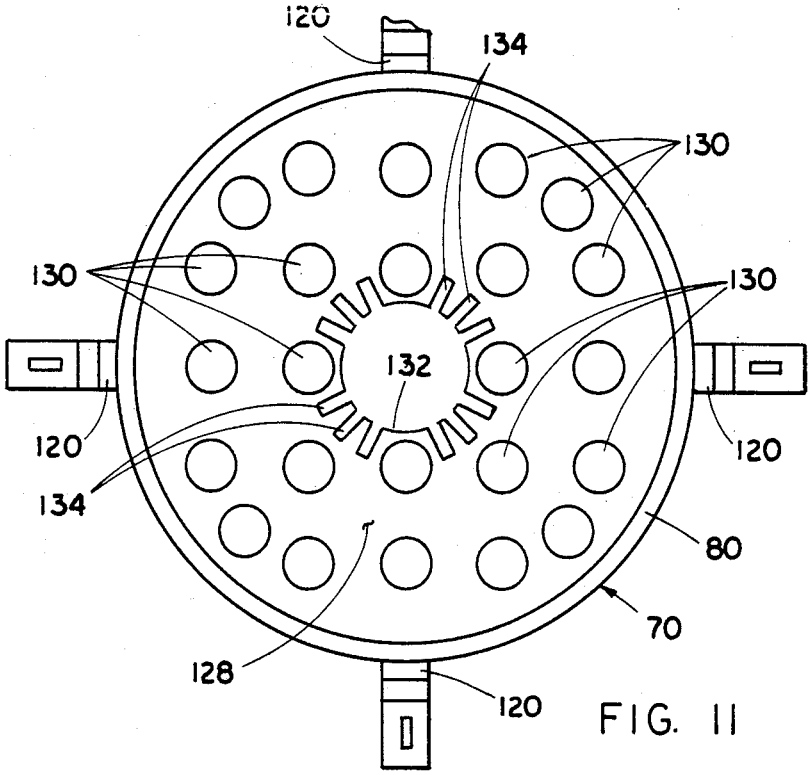
FIG. 11 is an enlarged top plan view of the body of the shipping container as seen along line 11—11 of FIG. 8.
Figure 12:
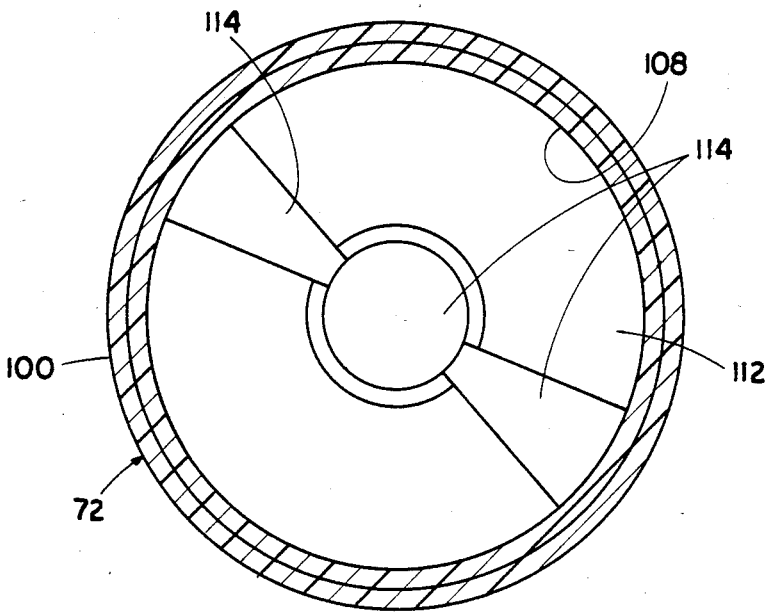
FIG. 12 is an enlarged cross-sectional view of a lid of the shipping container taken along line 12—12 of FIG. 8.

Turning now to FIGS. 4 and 5, also in the operation of a PWR it is desirable to prolong the life of the reactor core as long as feasible to better utilize the uranium fuel and thereby reduce fuel costs. To attain this objective, it is common practice to provide an excess of reactivity initially in the reactor core and, at the same time, provide means to maintain the reactivity relatively constant over its lifetime. Such means commonly takes the form of a poison assembly 50 which includes a plurality of reduced length burnable absorber rods 52 supported by a holddown subassembly 54.

More particularly, the holddown subassembly 54 which supports the absorber rods 52 in spaced side-by-side relationship includes a lower flat perforated support plate 56 which fits within the fuel assembly top nozzle 42 and rests on an adapter plate 58 of the top nozzle 32. The holddown subassembly 54 also includes a sleeve 60, being attached at its lower end within a central opening 62 in the support plate 56 and extending upwardly therefrom, and an upper holddown plate 64. Thus, the support plate 42 is held down against the top nozzle adapter plate 58 by a coil spring 66 which is compressed by the upper core plate (not shown) acting through the upper holddown plate 64. This arrangement assures that the absorber rods 52, being attached to the support plate 56 in a pattern matched to that of the guide thimbles 24 of the fuel assembly 10 and inserted therein, cannot be ejected from the fuel assembly 10 by upwardly-directed coolant flow forces.

Reactor Core Component Shipping Container

Referring now to FIGS. 6–13, there is illustrated a shipping container of the present invention, being generally designated 68. The container 68 is particularly suited for use in containing and supporting a nuclear core component, such as either the control or poison assembly 42,50, so as to facilitate its transport from the manufacturing facility to the site of the nuclear reactor. By way of example, in phantom line form in FIG. 13 the control assembly 42 is shown supported within the container 68. Hereinafter, the construction of the container 68 will be described in relation to employment with the control assembly 42, although it should be understood that it is equally useful in conjunction with the poison assembly 59.

With respect to its construction, the shipping container 68 includes a rigid cylindrical body 70, rigid cylindrical end cap or lid 72, a plurality of elongated tubes 74, spacing means in the form of a plurality of rigid flat cylindrical spacer plates 76, locking means in the form of a plurality of over-centering lock mechanisms 78, sealing means in the form of an annular gasket 80, and an attachment means in the form of an eyelet ring 82. The ring 82 is fixed on the lid 72 and adapted for connection to an external mechanism (not shown) to facilitate lifting of the container 68.

Figure 13:
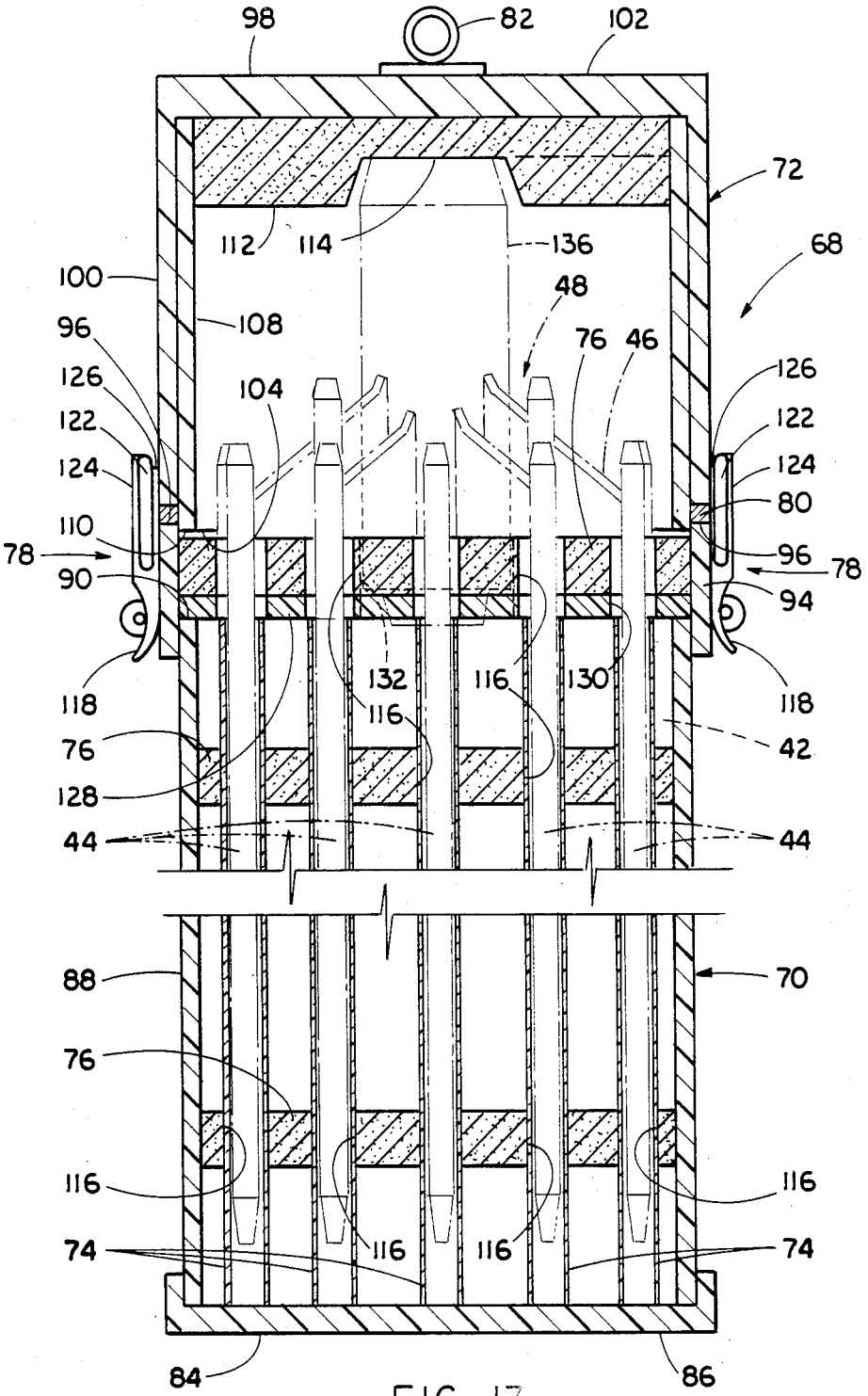
FIG. 13 is an enlarged longitudinal sectional view of the shipping container of FIG. 6, showing in phantom outline form a control assembly disposed therein.

More particularly, the cylindrical body 70 is preferably composed of a suitable plastic material, such as polyethylene. The body 70 is formed by a lower end cap 84 defining a closed flat bottom 86 and being fixed to the lower end of a continuous upright sidewall 88 having an upper edge 90 defining an open top 92 of the body 70. Also, an annular rim 94 is attached about the open top 92 of the body 70 and extends above its upper edge 90. Preferably, the annular gasket 80 is disposed on an upper edge 96 of the rim 94. The body 70 is of sufficient length and diameter to receive therein the elongated control rods 44 of the control assembly 42, as seen in FIG. 13.

The lid 72 of the container 68 is preferably composed of a suitable plastic material, such as polyethylene. The lid 72 is formed by an upper end wall 98 integrally connected with a continuous outer sidewall 100 to define a closed top 102 and an open bottom 104. The lid 72 is installable at a lower edge 106 on its outer sidewall 100 upon on the upper edge 96 of the rim 94 on the body 70. Actually, the annular gasket 80 is disposed between the respective upper and lower edges 96,106 of the respective sidewalls 88,100. Also, the lid 72 includes an inner continuous sidewall 108 fixed to the interior of the outer sidewall 100 and having a lower edge 110 which extends downward past the lower edge 106 of the outer sidewall 100. When the lid 72 is installed on the body, the lower edge 106 of the inner sidewall 108 of the lid extends downward past the upper edge 96 of the body sidewall 88 and the annular gasket 80 resting thereon.

Further, the lid 72 includes a structure in the form of a cylindrical slab 112 composed preferably of a suitable plastic foam material, such as ethafoam, and being fixed therein to the upper end portion of the inner sidewall 108 of the lid. The slab 112 has a central recess 114 defined therein adapted to receive and support the upper end of the spider subassembly 48 of the control assembly 42 when the lid 72 is installed on the body 70. If desired, the slab 112 may be compatible with both the spider subassembly 48 (RCC hub) and the burnable poison holddown plate 64.

The elongated tubes 74 of the container 68 are also preferably composed of polyethylene plastic material. They are placed in the body 70 for receiving the elongated control rods 44 of the control assembly 42 and for stablizing the rods during transport of the container 68. The tubes 74 have respective lengths just short of the length of the body sidewall 88. The tubes 74 are maintained in desired side-by-side spaced apart relationship with respect to one another by the plurality of cylincrical spacer plates 76 preferably composed of foam plastic material. The plates 76 in being attached to the interior of the body sidewall 88 are disposed stationarily within and transversely across the body 70 and spaced apart from one another axially along the body. Each plate 76 has a plurality of openings 116 therethrough defined in a pattern matching that of the array of control rods 44. Thus, the tubes 74 slidably received and disposed through the plate openings 116 are maintained in the desired transverse side-by-side spaced relationship which matches the pattern of the array of control rods 44. The plates 76 thus serve to laterally support the tubes 74 and thereby the control rods 44 of the control assembly 42 when installed in the body 70.

Each over-centering lock mechanism 78 includes an actuating handle 118 pivotally mounted to a segment 120 on the body rim 96. A ring element 122 is pivotally coupled to the handle 118. Another segment 124 on the lid sidewall lower edge 106 which aligns with the body segment 120 has a recessed notch 126 defined on its upper end. After installation of the lid 72 on the body 70, to latch the lid on the body each ring element 122 is first pivoted upwardly so that its upper end overlies one of the notches 126. Then the actuating handle 118 is pivoted downwardly past overcenter and against the exterior of the lid sidewall 100 to the position shown in FIG. 6, capturing the upper end of the ring element 122 in the notch 126. By reverse pivotal movement of the handle 118, each ring element 122 is released from the notch 126 and the lid 72 thereby becomes unlatched from the body 70.

For supporting the spider subassembly 48 of the control assembly 42 within the container 68, a rigid cylindrical flat support plate 128 of polyethylene plastic material is disposed within the body rim 94 and above the upper edge 90 of the body sidewall 88. The support plate 128 has a plurality of holes 130 in a pattern matching the openings 116 through the spacing plates 76. One of the spacing plates 76, having a slightly larger diameter than the others, is disposed within the rim 94 and below and above and in contact with the support plate 128 and body sidewall upper edge 90. The support plate 128 and uppermost one of the spacing plates 76 also have respective large diameter central openings 132 formed therethrough from which radiate short passages 134. The openings 132 and passages 134 respectively seat a central post 136 and the lower edges of the flukes 46 of the control assembly 42.

As an option, some containers 68 may be outfitted with fill and exhaust valves located respectively in the top and bottom ends of the container to facilitate purging and filling of the container with a dry gas, such as nitrogen.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A nuclear core component shipping container, comprising:

(a) a rigid tubular body having opposite closed and open ends for receiving a nuclear core component;

(b) a plurality of elongated tubes insertable in said body for receiving and stabilizing members of the nuclear core component during transport of said container;

(c) spacing means disposable within and transversely across said body having a plurality of openings therethrough for receiving and disposing said tubes in side-by-side spaced relationship with respect to one another in, and extending between said closed and open ends of, said body, said spacing means for laterally spacing and supporting said core component members when received in said tubes;

(d) a rigid tubular end lid having opposite closed and open ends and being installable at its open end on said open end of said body, said lid being hollow for receiving a common mounting structure of the core component when said lid is installed on said body; and (e) locking means on said lid and said body and being actuatable for latching and unlatching said lid to and from said body.

2. The shipping container as recited in claim 1, wherein said body and lid are cylindrical in configuration and composed of plastic material.

3. The shipping container as recited in claim 2, wherein said plastic material is polyethylene.

4. The shipping container as recited in claim 1, wherein each of said tubes is composed of a plastic material.

5. The shipping container as recited in claim 4, wherein said plastic material is polyethylene.

6. The shipping container as recited in claim 1, wherein said spacing means is composed of a plastic foam.

7. The shipping container as recited in claim 1, wherein said spacing means includes a plurality of flat cylindrical plates spaced apart axially along said body and said tubes contained therein.

8. The shipping container as recited in claim 7, wherein each of said plates is composed of a plastic foam.

9. The shipping container as recited in claim 1, further comprising:

(f) an annular sealing element disposable between said open end of said lid and said open end of said body for providing an air-tight seal between said body and lid upon latching said lid to said body by actuation of said locking means.

10. The shipping container as recited in claim 7, wherein said body includes:

an annular rim attached about said open end of said body; and a rigid flat plate disposed within said rim and above an edge of said body defining said open end thereof, said plate having a plurality of openings matching said openings through said spacing means.

11. The shipping container as recited in claim 10, wherein one of said flat cylindrical plates of said spacing means is disposed within said rim and between said rigid flat plate and body edge.

12. The shipping container as recited in claim 1, wherein said lid includes core component supporting structure disposed therein.

13. The shipping container as recited in claim 1, wherein said locking means includes a plurality of overcentering lock mechanisms.

14. The shipping container as recited in claim 1, further comprising:

(f) attachment means disposed on at least one of said body and lid for connecting an external lifting mechanism thereto to facilitate transporting of said container.

15. A shipping container for use in containing and supporting a nuclear core component assembly having a common mounting structure and a plurality of spaced elongated members supported by the common structure and extending therefrom in a common direction, said shipping container comprising:

(a) a rigid cylinder body of plastic material having a closed bottom and an open top for receiving therein the elongated members of the nuclear core component assembly;

(b) a plurality of elongated tubes of plastic material inserted in said body for receiving and stabilizing the elongated members of the nuclear core component assembly during transport of said container;

(c) a plurality of rigid flat cylindrical spacer plates of foam plastic material disposed stationarily within and transversely across said body and spaced apart from one another axially along said body, each of said plates having a plurality of openings therethrough receiving and disposing said tubes in transverse side-by-side spaced relationship with respect to one another in, and extending between said closed bottom and open top of, said body, said plates for laterally spacing and supporting the core component members when received in said tubes;

(d) a rigid cylindrical end lid composed of plastic material having a closed top and an open bottom and being installable at its open bottom on said open top of said body, said lid being hollow for receiving therein the common mounting structure of the core component assembly when said lid is installed on said body;

(e) locking means on said lid and said body and being actuatable for latching and unlatching said lid to and from said body; and (f) a sealing element disposable between said open bottom of said lid and said open top of said body for providing an air-tight seal between said body and lid upon latching said lid to said body by actuation of said locking means.

16. The shipping container as recited in claim 15, wherein said plastic material of said body, lid and tubes is polyethylene.

17. The shipping container as recited in claim 15, wherein said body includes:

an annular rim attached about said open top of said body; and a rigid flat support plate of plastic material disposed within said rim and above an edge of said body defining said open top thereof, said plate having a plurality of openings matching said openings through said spacing plates, said support plate for supporting the common mounting structure when received in said hollow lid.

18. The shipping container as recited in claim 17, wherein said sealing element is an annular gasket disposed on an upper edge of said rim.

19. The shipping container as recited in claim 17, wherein one of said spacing plates is disposed within said rim and between said support plate and body edge.

20. The shipping container as recited in claim 15, wherein said lid includes structure disposed therein of plastic foam material for supporting the common mounting structure of the core component assembly.

21. The shipping container as recited in claim 15, wherein said locking means includes a plurality of overcentering lock mechanisms.

22. The shipping container as recited in claim 15, further comprising:

(g) attachment means disposed on at least one of said body and lid for connecting an external lifting mechanism thereto to facilitate transporting of said container.

23. In combination with a nuclear core component assembly having a common mounting structure and a plurality of spaced elongated members supported by said common structure and extending therefrom in a common direction, a nuclear core component shipping container comprising:

(a) a rigid cylinder body of plastic material having a closed bottom and an open top and receiving therein said elongated members of said nuclear core component assembly;

(b) a plurality of elongated tubes of plastic material inserted in said body and receiving said elongated members of said nuclear core component assembly, said tubes stabilizing said members during transport of said container with said core component assembly therein;

(c) a plurality of rigid flat cylindrical spacer plates of foam plastic material disposed stationarily within and transversely across said body and spaced apart from one another axially along said body, each of said plates having a plurality of openings therethrough receiving and disposing said tubes in transverse side-by-side spaced relationship with respect to one another in, and extending between said closed bottom and open top of, said body, said plates laterally spacing and supporting said core component members received in said tubes;

(d) a rigid cylindrical end lid composed of plastic material having a closed top and an open bottom and being installable at its open bottom on said open top of said body, said lid being hollow for receiving therein said common mounting structure of said core component assemby when said lid is installed on said body;

(e) locking means on said lid and said body and being actuatable for latching and unlatching said lid to and from said body; and (f) a sealing element disposable between said open bottom of said lid and said open top of said body for providing an air-tight seal between said body and lid upon latching said lid to said body by actuation of said locking means.

24. The shipping container as recited in claim 23, wherein said plastic material of said body, lid and tubes is polyethylene.

25. The shipping container as recited in claim 23, wherein said body includes:

an annular rim attached about said open top of said body; and a rigid flat support plate of plastic material disposed within said rim and above an edge of said body defining said open top thereof, said plate having a plurality of openings matching said openings through said spacing plates, said support plate supporting said common mounting structure of said core component assembly.

26. The shipping container as recited in claim 25, wherein said sealing element is an annular gasket disposed on an upper edge of said rim.

27. The shipping container as recited in claim 25, wherein one of said spacing plates is disposed within said rim and between said support plate and body edge.

28. The shipping container as recited in claim 23, wherein said lid includes structure disposed therein of plastic foam material receiving and supporting said common mounting structure of said core component assembly when said lid is installed on said body.

29. The shipping container as recited in claim 23, wherein said locking means includes a plurality of overcentering lock mechanisms.

30. The shipping container as recited in claim 23, further comprising:

(g) attachment means disposed on at least one of said body and lid for connecting an external lifting mechanism thereto to facilitate transporting of said container.

* * * * *